United States Patent [19]

Blaese

[11] 4,266,227

[45] May 5, 1981

[54] MOUNTING FOR MOBILE COMMUNICATIONS ANTENNA

[75] Inventor: Herbert R. Blaese, Chicago, Ill.

[73] Assignee: Avanti Research & Development, Inc., Addison, Ill.

[21] Appl. No.: 67,804

[22] Filed: Aug. 20, 1979

[51] Int. Cl.[3] ..... H01Q 1/32

[52] U.S. Cl. ..... 343/715

[58] Field of Search ..... 343/715, 881, 882, 900, 343/901, 711, 712, 713

[56] References Cited

U.S. PATENT DOCUMENTS

| | | | |
|---|---|---|---|
| 2,161,707 | 6/1939 | Hathaway | 343/900 |
| 2,397,151 | 3/1946 | Mitchell | 343/900 |
| 2,894,260 | 7/1959 | Ellis | 343/901 |
| 3,264,647 | 8/1966 | Nuttle | 343/900 |
| 3,304,037 | 2/1967 | Candela | 343/882 |
| 4,109,251 | 8/1978 | MacDougal | 343/882 |

FOREIGN PATENT DOCUMENTS

| | | | |
|---|---|---|---|
| 1132608 | 9/1960 | Fed. Rep. of Germany | 343/715 |

*Primary Examiner*—Eli Lieberman

*Attorney, Agent, or Firm*—Dressler, Goldsmith, Shore, Sutker & Milnamow, Ltd.

[57] ABSTRACT

An apparatus for mounting a mobile transmitting and receiving antenna to an automobile windshield or rear window is disclosed. The antenna is screwed into a socket of an antenna mount and is secured with a finger tightened lock nut. Confronting friction surfaces of the lock nut and socket are of a frusto-conical configuration. The lock nut generates a compression friction fit with the socket and resists vibration forces from vehicle movement, thereby preventing the antenna from disengaging from the socket. The antenna may be easily removed when desired by finger loosening the lock nut. The socket is attached to the base of the mount by two opposing screws. Each screw is oriented whereby when a flex force due to wind or otherwise is exerted on the antenna and a subsequent torque is transmitted to the base of the mount one of these screws will always resist a torque about an axis defined by these screws. The antenna is thereby maintained in a desired orientation by the arrangement of these opposing screws.

7 Claims, 3 Drawing Figures

MOUNTING FOR MOBILE COMMUNICATIONS ANTENNA

DESCRIPTION

TECHNICAL FIELD

The present invention relates to a mount for a mobile communications antenna and particularly to a mount which will stabilize the base of an antenna that experiences forces due to vehicle movements. Furthermore, this mount secures the antenna from disengaging because of vehicle vibrations and provides for easy removal of the antenna when desired.

In mounting an antenna onto a vehicle it is desirable to be able to select an orientation of the antenna member for optimum reception and transmission and to maintain this posture. This can be a difficult task when the antenna transmits varying torques to the mount due to movements of the vehicle. It is also important that the antenna be easily removable from the mount for storage, protection from theft and when the vehicle is being washed. However, when the antenna is secured, it must be engaged sufficiently to the mount to prevent possible loss of the antenna due to inadvertent loosening from vehicle vibrations.

BACKGROUND ART

The prior art does not provide for a mounting assembly which secures the antenna from disengaging because of vehicle vibrations by merely finger tightening and at the same time, allows for expeditious removal of the antenna for protective measures by merely finger loosening. In the past, mounting assemblies did not provide means for easily changing an antenna and thereafter maintaining a selected antenna orientation by resisting torques transmitted to the mount due to flex forces exerted on the antenna from vehicle movement.

Traditional mounting of a mobile antenna involved fastening the antenna to a metal portion of the vehicle, as through a bored hole. Should another location of the antenna be desired for improved transmission and reception, another hole would have to be bored into the vehicle body.

Rear deck mounting assemblies have been developed that do not require holes to be bored in the vehicle body. These assemblies have provided features of easily placing the assembly and antenna into the trunk of the vehicle when desired for protective measures. However, due to the rear deck location, a portion of the antenna is generally below the vehicle's metallic roof plane causing some interference in transmitting and receiving a uniform radiation pattern.

Mountings which are mounted to glass have also been developed. These mounts will generally project the antenna over the vehicle's metallic roof plane thereby minimizing transmission and reception interference. Attaching these mounts has usually involved adhering the mount to the glass surface.

DISCLOSURE OF INVENTION

The antenna mounting assembly of the present invention provides for simple finger tightening and prevents inadvertent loosening and disengaging of the antenna due to vehicle vibrations and permits easy removal by simple finger loosening when desired for purposes of protecting the antenna. The mounting assembly provides opposing screws which, when a desired orientation of the antenna is selected, may be tightened and thereafter resist torques transmitted from the antenna due to vehicle movement thereby maintaining the selected antenna posture.

This mount has a threaded socket which receives an antenna having a threaded base. A lock nut having a tapered head is then finger tightened down onto the socket wherein the tapered head makes a compression friction fit with the socket. The desirable aspect of this lock nut is that the compression friction fit generated will resist vehicle vibrations yet can be easily overcome by finger loosening for convenient removal when desired.

The socket of this mount has a unidirectional threaded bore through its base. Two substantially identical screws are threadingly disposed into opposite ends of the bore attaching the socket to the base of the mount. When a selected orientation of the socket is obtained, the screws are easily tightened. The advantage of this securance is that one screw will always tighten if the other screw should loosen thereby to resist a torque that is generated by antenna movement about an axis defined by the threaded bore, hence maintaining the selected antenna orientation.

BRIEF DESCRIPTION OF DRAWINGS

Further objects, features and advantages of this invention will become apparent from the drawings which illustrate the presently preferred embodiment for carrying out the invention.

THE PRESENTLY PREFERRED EMBODIMENT

Figure 1:
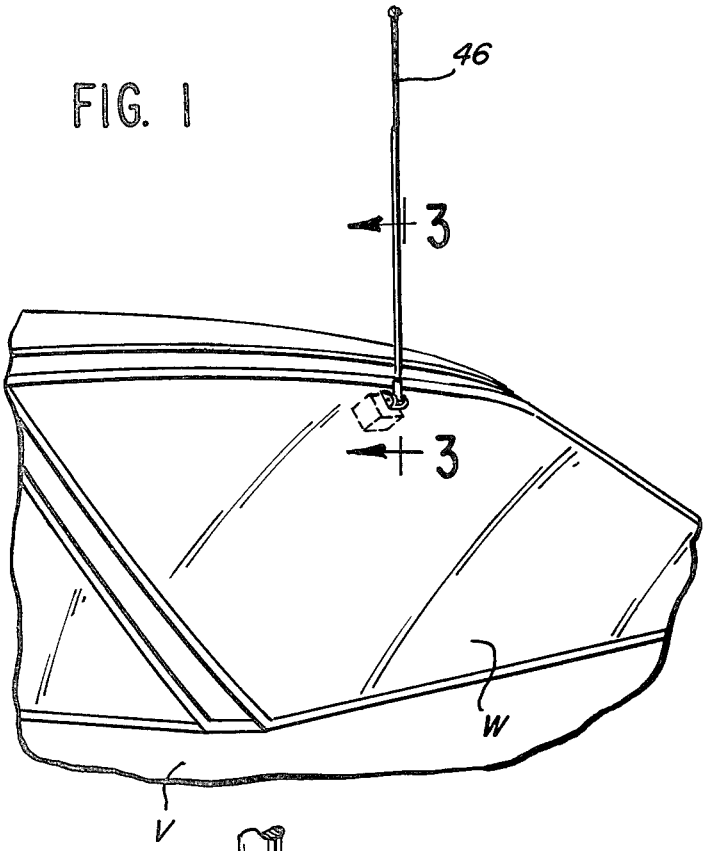
FIG. 1 is a perspective view of an antenna mounting apparatus of this invention typically attached to a glass surface of a vehicle.

While this invention is susceptible of embodiment in many different forms, there is shown in the drawings and will herein be described in detail a presently preferred embodiment, with the understanding that the present disclosure is to be considered as an exemplification of the principles of the invention and is not intended to limit the invention to the embodiment illustrated.

The drawings illustrate an antenna assembly adapted for mounting to a vehicle and, in the embodiment illustrated, to the windshield or rear window of a vehicle. The antenna assembly is specially designed for securing an elongated radiating member or whip 46 against dislodgement or rearward or forward movement due to vibration induced by the vehicle and air movement, thereby stabilizing and maintaining the predetermined position of the antenna whip 46 during vehicle movement, while also providing for easy removal of the antenna whip 46 when desired.

The antenna assembly comprises a base mounting member 10 attaching the antenna assembly to the vehicle V.

Mounting member 10 comprises a plate like base 12 having a mounting face 13. Face 13 is in face-to-face contact with rear window W and is secured thereto by a suitable adhesive which preferably permits ready removal of the member 10 when removal is desired. Attaching the member 10 by an adhesive to non-conducting surfaces such as glass is a preferred approach.

Mounting member 10 may function as one of the capacitor members of the coupling capacitor as disclosed in U.S. Application Ser. No. 890,380, filed Mar. 27, 1978, thereby to transmit through the glass as disclosed in said application.

Figure 2:
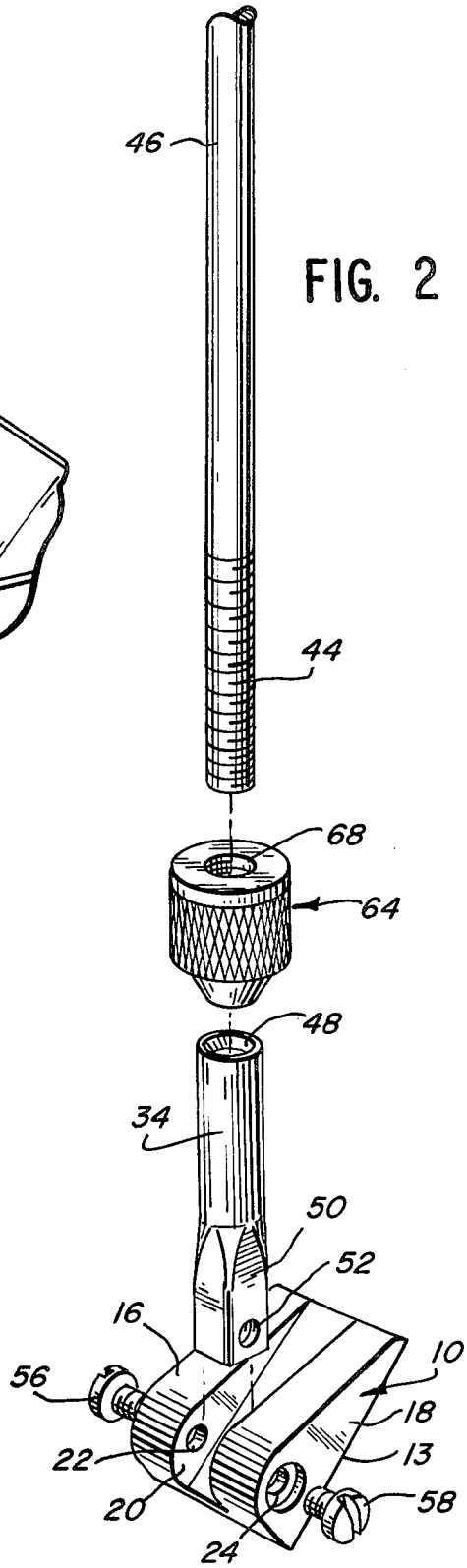
FIG. 2 is an exploded perspective view of the antenna mounting apparatus of FIG. 1.
Figure 3:
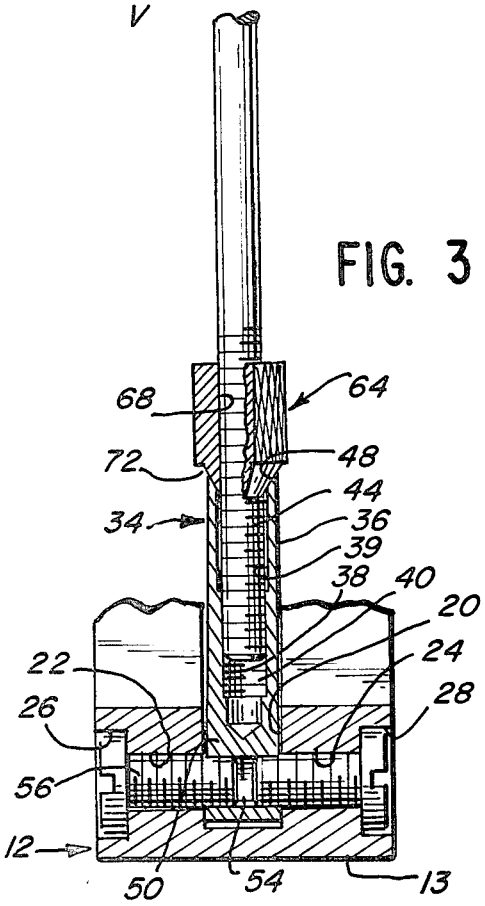
FIG. 3 is a sectional view taken substantially along a plane indicated by section line 3—3 in FIG. 1.

Mounting member 10 further comprises two generally parallel wall members 16 and 18 which are integral with and extend upwardly from base 12. Together they define a groove 20 therebetween. Sidewalls 16 and 18 define right cylindrical bores 22 and 24, and as seen in FIGS. 2 and 3, bores 22 and 24 align with each other directly across the groove 20. Bores 22 and 24 terminate in larger diameter countersunk seats 26 and 28, respectively. Preferably mounting member 10 is a weather resistant, chrome-plated casting.

A whip holding means, such as a socket means 34 of a weather resistant chrome plated casting, is provided for securance to member 10. Socket 34 comprises an upper tubular portion 36. Portion 36 defines a lower threaded bore segment 38 and an upper unthreaded socket bore segment 39. Threads 40 are complementary to threads at the end of whip 46. The uppermost portion of socket 34 defines an annular friction bearing surface 48 which is a beveled surface opening upwardly and outwardly and defining a frusto-conical configuration for a purpose to be described.

Socket 34 further comprises a lower portion 50 having a generally square horizontal cross-section. The width of lower portion 50 is very slightly less than the width of groove 20. Lower portion 50 defines a threaded socket bore 52 wherein the thread 54 is continuous and unidirectional throughout. Threaded socket bore 52 is aligned to communicate with bores 22 and 24 when lower portion 50 is inserted into groove 20.

A pair of screws 56 and 58, preferably of stainless steel, are respectively inserted into bores 22 and 24. Screws 56, 58 have identical threads and threadingly engage thread 54, at which time socket 34 is adjusted to the orientation desired for antenna whip 46. Screws 56 and 58 are then finally tightened by turning them in opposite directions relative to one another and the heads 60 and 62 are seated in countersunk seats 26 and 28 respectively. When forces are exerted on whip 46 due to vehicular movement, the wind forces or otherwise which tend to alter the disposition of the whip 46, movement of the socket 34 from the pre-set position is resisted because one of screws 56, 58 will resist clockwise torque and the other will resist counter-clockwise torque. In other words one screw will tend to tighten the connection between socket 34 and member 10 to resist relative movement if the other screw should tend to loosen, unlike constructions wherein both screws will tighten or loosen together. Thus, socket 34, hence whip 46, will be stabilized and maintained in its desired position.

The stability of the antenna assembly of this invention is further enhanced by the means for securing the whip to the socket 34. As seen in FIGS. 2 and 3, antenna whip 46 defines a threaded end 44. Threaded end 44 has a thread which is complementary to the thread 40 of bore segment 38 and to those of a securing means, such as a locking nut 64. Locking nut 64 defines an opening having threads 68. The generally cylindrical exterior of locking nut 64 is knurled for aiding in finger-turning and tightening. The bottom portion of locking nut 64 has a confronting friction bearing surface such as a tapered or frusto-conical head 72 having a configuration complementary to annular friction bearing surface 48.

In use, locking nut 64 is screwed onto threaded end 44 of antenna 46 whereby a portion of the threaded end of whip 46 protrudes through locking nut 64. The threaded end is then inserted into socket 34. Unthreaded bore segment 39 guides the whip end to the threaded segment 38 and the whip is then screwed into the threaded portion shown in FIG. 3. Thereafter, locking nut 64 is hand-turned down until frusto-conical head 72 firmly engages friction bearing surface 48 of socket 34. It has been found by providing the tapered frusto-conical mating frictional surfaces that sufficient frictional resistance to auto-disengagement is provided by simple finger-tightening without tools so that whip 46 is prevented from loosening and disengaging from socket 34 because of vehicle and wind vibrations. Yet, it has also been found that locking nut 64 may be easily rotated by hand, and without tools, so as to disengage whip 46 when desired.

From the foregoing detailed description, it will be observed that variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An antenna assembly for a mobile transmitting and receiving antenna comprising:

a mounting member comprising a base and a pair of spaced wall members projecting upwardly from said base defining a groove therebetween, each wall member defining a bore, said mounting member being adapted to be mounted on the surface of a vehicle;

socket means, said socket means being adapted to mount an elongated radiating member and to secure said radiating member to said mounting member, said socket means comprising a lower portion proportioned to be positioned in said groove and defining a threaded socket bore in alignment with the bores in said wall members, the thread in said threaded bore being continuous and unidirectional;

and a pair of substantially identical screws, one being disposed in each of the wall member bores and being in threaded engagement with the threaded socket bore to secure said socket means in a predetermined disposition and against dislodgement;

whereby when forces are exerted on said socket means to tend to move said socket means about the axis of the threaded socket bore, if one of said screws tends to loosen its engagement therewith the other tends to tighten its engagement therewith, thereby tending to maintain the predetermined disposition of said socket means with respect to said mounting member.

2. An antenna assembly in accordance with claim 1 wherein said wall member bores align directly across said groove.

3. An antenna assembly in accordance with claim 1 wherein said radiating member defines a threaded end adapted to be received within said socket means.

4. An antenna assembly in accordance with claim 3 wherein said socket means comprises an upper tubular portion for threadingly receiving said radiating member, and said lower portion defines said threaded socket bore and is generally rectangular in cross-section.

5. An antenna assembly in accordance with claim 4 wherein said upper tubular portion defines an upper unthreaded socket bore segment for guiding said radiating member into the upper tubular portion.

6. An antenna assembly in accordance with claim 3 further including a threaded locking nut on said threaded end and wherein said socket means defines an annular friction bearing surface adjacent the upper end of said socket means, and wherein said locking nut defines a confronting friction bearing surface, whereby when said friction bearing surfaces flushly engage, they generate a compression friction fit securing said radiating member from inadvertently disengaging due to vibration.

7. An antenna assembly in accordance with claim 6 wherein said friction bearing surfaces are frusto-conical.

* * * * *